United States Patent [19]

Marforio

[11] 4,061,097

[45] Dec. 6, 1977

[54] UNIT FOR AUTOMATICALLY SEWING THE OPPOSITE EDGES OF PIECE OF FABRIC

[75] Inventor: Nerino Marforio, Milan, Italy

[73] Assignee: Rockwell-Rimoldi S.p.A., Milan, Italy

[21] Appl. No.: 727,877

[22] Filed: Sept. 29, 1976

[30] Foreign Application Priority Data

Oct. 3, 1975 Italy ..... 27915/75

[51] Int. Cl.[2] ..... D05B 21/00

[52] U.S. Cl. ..... 112/121.15

[58] Field of Search ..... 112/121.15, 155, 121.11, 112/121.12

[56] References Cited

U.S. PATENT DOCUMENTS

| | | | |
|---|---|---|---|
| 810,297 | 1/1906 | Miller | 112/155 X |
| 3,224,394 | 12/1965 | Dobner et al. | 112/121.15 X |
| 3,232,256 | 1/1966 | Buckalter | 112/155 X |
| 3,799,082 | 3/1974 | Redman | 112/121.15 X |
| 3,808,993 | 5/1974 | Heiler et al. | 112/155 |

*Primary Examiner*—Alfred R. Guest

[57] ABSTRACT

A machine for automatically sewing the opposite non-parallel edges of a piece of fabric which includes first and second sewing stations spaced on opposite sides of a work bed in which means is provided at the exit end of the first sewing station to grip and to rotate the fabric into a position where the second edge to be sewn is parallel to the direction of stitching to be performed at the second sewing station and further including means to translationally move the work fabric from the first sewing station to the second upon completion of sewing at the first station.

2 Claims, 5 Drawing Figures

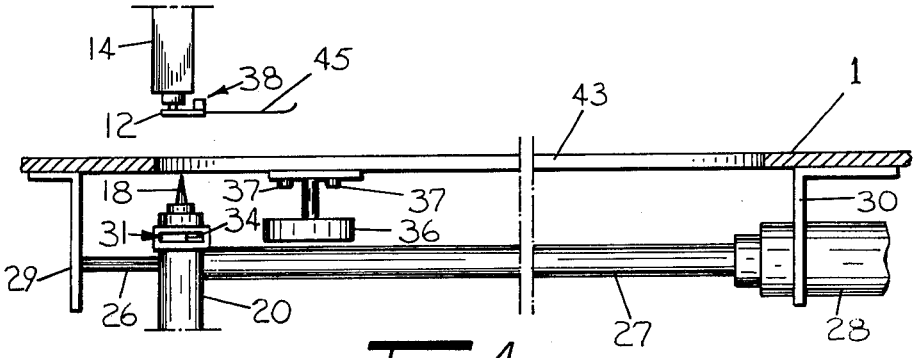
Fig. 4
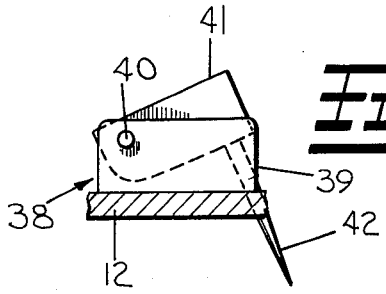
Fig. 3
Fig. 2
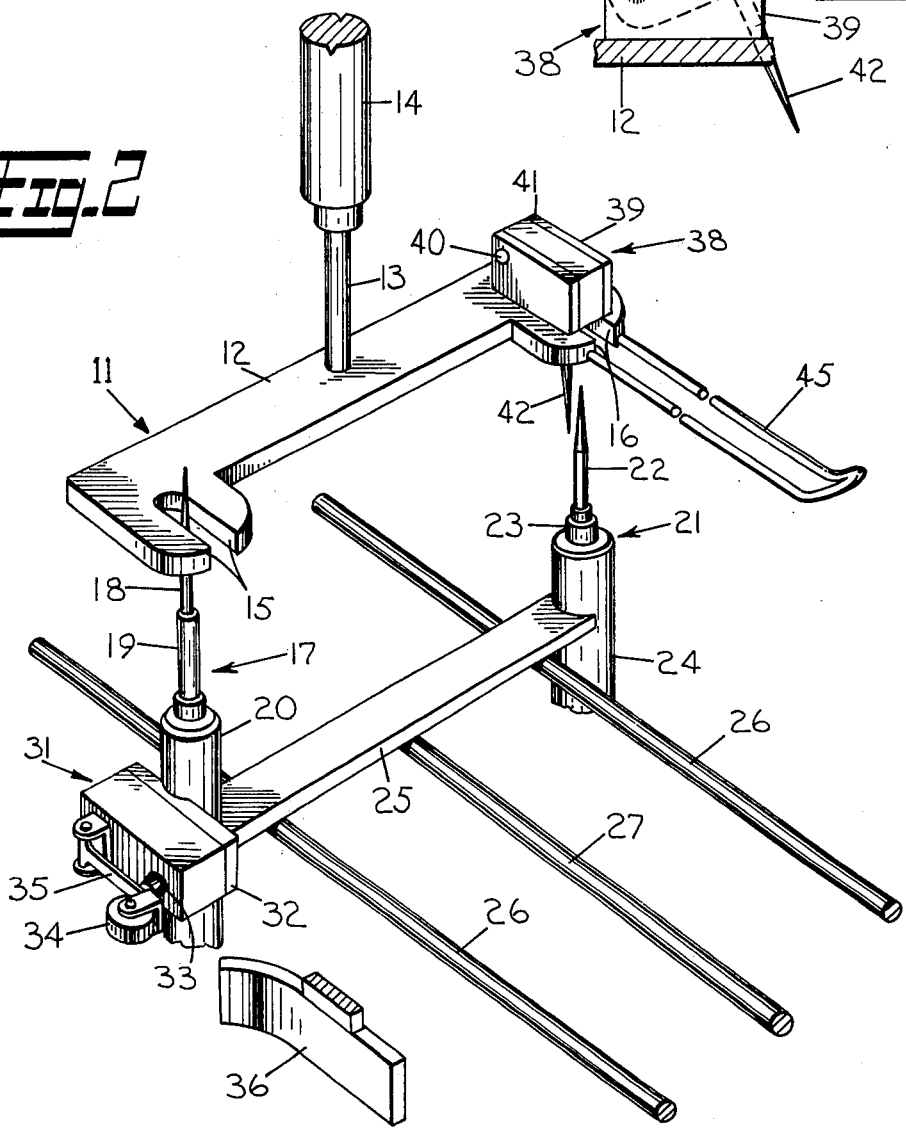

UNIT FOR AUTOMATICALLY SEWING THE OPPOSITE EDGES OF PIECE OF FABRIC

BACKGROUND OF THE INVENTION

Hitherto, the operation of sewing the opposite edges of a piece of fabric has been carried out by means of a first and a second sewing machine which are spaced apart from one another and which are each provided with their own respective feeding mechanisms; a device for transferring the piece of fabric from one machine to the other being disposed between the aforementioned sewing machines.

However, this method of sewing has been limited to pieces of fabric whose opposite edges were substantially parallel and thus the transfer of this fabric from one machine to the other was carried out by means adapted to perform a rectilinear translational movement.

In the case of pieces of fabric with non-parallel opposite edges, for example, flared parts of shirts, i.e., having a substantially trapezoidal form, these transfer movements from one machine to the other are effected manually as it is not suitable to use the aforementioned rectilinear translation means.

The object of the present invention is to be able to automatically sew the opposite non-parallel edges of trapezoidal pieces of fabric, i.e., in a simple manner which does not require any special skill on the part of the operator.

The technical problem to be solved in order to achieve this object is that of arranging the edge still to be sewn in such a way that it is aligned with the feeding mechanism of a second machine after the first edge has already been sewn by a first sewing machine.

SUMMARY OF THE INVENTION

The solution to the aforementioned technical problem is provided according to the invention by means of a unit of the aforementioned type wherein the means for transferring the fabric from one machine to the other comprise rotation and translation means which are adapted, in a first stage, to direct the edge of the fabric turned towards the second sewing machine according to the feed direction of the latter and, in a second stage, to move the fabric towards the second sewing machine; this device for moving the fabric also comprising control means cooperating with the rotation and translation means for the purpose of interrupting the first stage and beginning the second.

Another feature of the present invention consists in that the device for transferring the fabric comprises a retaining element designed to temporarily retain the fabric, a first fabric drawing element which is spaced apart from the retaining element, a second drawing element which cooperates with the first drawing element and which is movable together with the latter, control means consisting of a position checking and plotting element rigidly connected to the first drawing element for the purpose of determining when the second drawing element is acting on the fabric and for simultaneously determining when the retaining element has been withdrawn.

These and other features of the present invention will be made apparent in the course of the following description of a preferred but not exclusive embodiment thereof provided by way of example only with reference to the accompanying drawings, in which:

BRIEF DESCRIPTION OF THE DRAWINGS

FIG. 2 is a perspective view of the fabric transfer device forming part of the unit according to the invention;

FIG. 3 shows a feature according to FIG. 2;

FIG. 4 is a front view of the device shown in FIG. 2; and

DESCRIPTION OF THE PREFERRED EMBODIMENT

Figure 1:
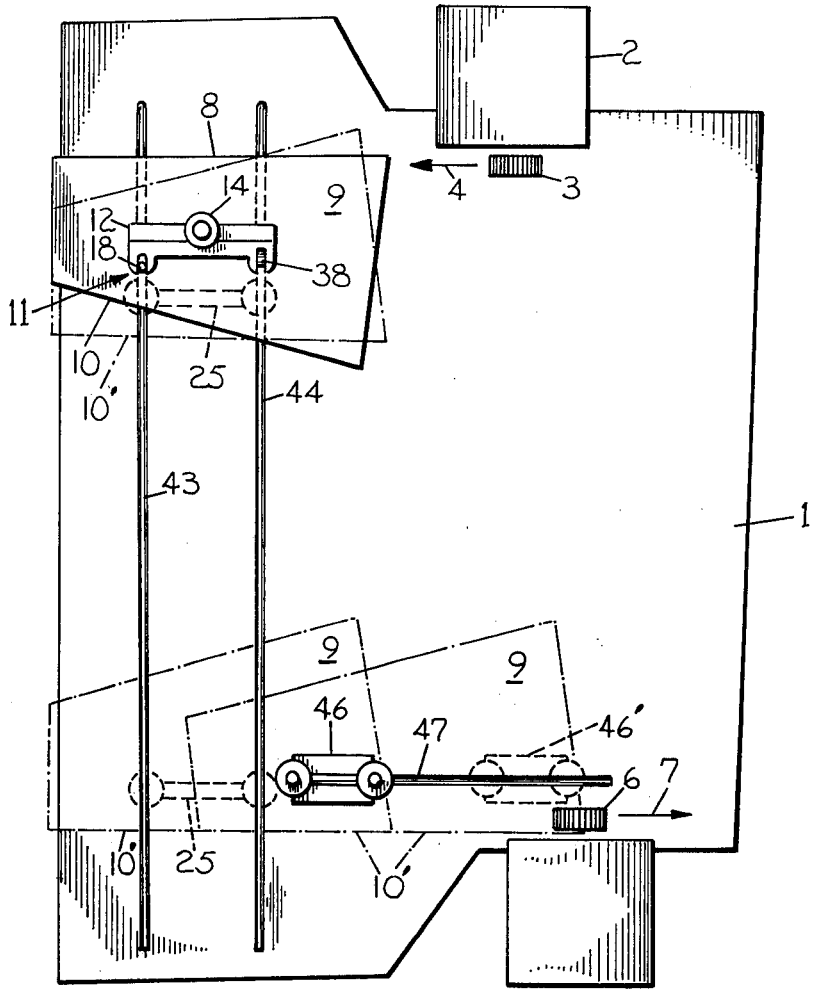
FIG. 1 is a plan view in diagrammatic form of the unit according to the invention.

Referring now to FIG. 1 the unit according to the invention comprises a work bed plate 1, on one side of which is disposed a first sewing machine 2 equipped with its respective feeding mechanism 3 operating in the direction of the arrow 4.

A second sewing machine 5 is also disposed on the work bed plate 1 on the opposite side to that on which the first sewing machine 2 is disposed.

The sewing machine 5 is equipped with its own respective feeding mechanism 6 operating in the direction of the arrow 7. The two directions 4 and 7 of the feeding mechanisms 3 and 6 are substantially parallel and oppositely directed. The first sewing machine 2 is used to sew the edge 8 of a piece of fabric 9 and the second sewing machine 5 is used to sew the opposite edge 10 of this piece of fabric.

The piece of fabric 9 consists, for example, of a flared part of a shirt, wherein the edges 8 and 10 are non-parallel.

A device 11 for transferring the fabric 9 from the first to the second machine is disposed between the output of the first machine 2 and the input of the second machine 5. As represented more clearly in FIG. 2, the device 11 comprises a pressure plate 12 integral with the rod 13 of a pneumatic cylinder 14.

The pressure plate 12 comprises two openings 15 and 16.

A first drawing element 17 for the piece of fabric 9 consists of a pin 18 which is rigidly connected to the rod 19 of a pneumatic cylinder 20. A second drawing element 21 for the fabric 9 is similarly formed of a pin 22 integral with the rod 23 of a pneumatic cylinder 24. The first and second drawing elements are interconnected by means of a cross-piece 25 slidable on two bars 26 substantially perpendicular to the two feeding directions 4 and 7.

Figure 5:
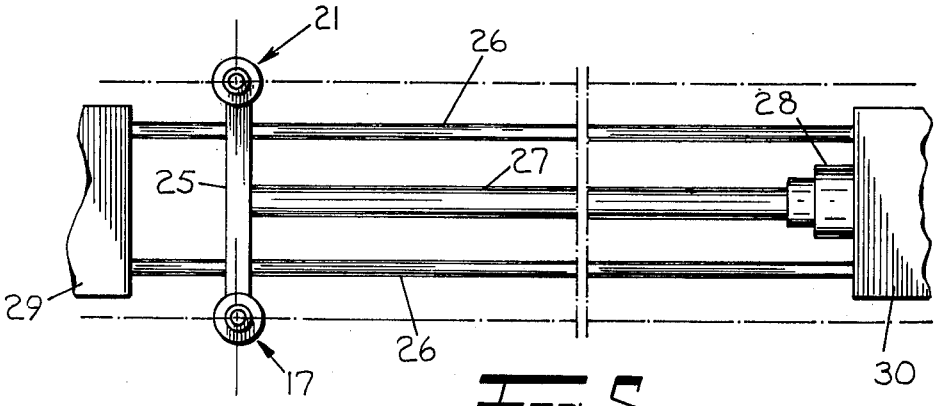
FIG. 5 is a partial plan view of the device shown in FIG. 2.

As represented in FIG. 5 the cross-piece 25 is rigidly connected to the rod 27 of a cylinder 28 to produce the sliding movement of the same. Beneath the work bed plate 1 there is disposed, on the one hand, a support 29 which supports the bars 26 and, on the other hand, a support 30 which supports both the bar 26 and the cylinder 28.

A position plotting element 31 is attached to the cylinder 20. The position plotting element 31 consists of a microswitch 32 which is equipped with an actuating element 33 which is acted on by a roller sensing element 34 mounted on hinged element 35. The roller sensing element 34 is designed to cooperate with a checking member 36 which is adjustably attached to the underside of the work bed plate 1 by means of screws 37.

Referring now to FIGS. 2 and 3, a retaining element 38 is attached to the pressure plate 12. The retaining element 38 consists of a support 39, to which a block 41 bearing a pin 42 is hinged at 40; the pin 42 being designed to pass through the opening 16.

The work bed plate 1 is equipped with two parallel slits 43 and 44 (FIG. 1) through which the pins 18 and 22 are adapted to pass. The pin 42 is also designed to pass through the slit 44.

Another pressure element 45 is attached to the pressure plate 12 in front of the opening 16.

The above-described sewing unit operates in the following manner:

When the edge 8 of the piece of fabric 9 is being sewn by means of the sewing machine 2, the cylinder 14 keeps the pressure plate 12 in a raised position with respect to the work bed plate 1. The cylinders 20 and 24 keep the pins 18 and 22 beneath the work bed plate 1 such that the piece of fabric 9 is free to leave the machine 2 so as to be disposed between the plate and pressure element 12, 45, and the pins 18 and 22. At this point, a manual or automatic control means causes the cylinder 14 to lower the pressure plate 12 such that the pin 42 penetrates the fabric 9 and the slit 44. The cylinder 20 is then actuated and it raises the pin 18 which, passing through the slit 43, penetrates the fabric 9 and passes into the opening 15 in the pressure plate 12 above the fabric. The pressure plate 12 is designed to prevent the fabric from being raised when the pin is raised and thus to facilitate the penetration thereof in the fabric 9. The displacement of the cross-piece 25, and therefore of the pin 18, is now begun by means of the cylinder 28. The displacement of the pin 18, in cooperation with the pin 42, produces the rotation of the fabric 9, about the pin 42.

The retaining element 38, together with the first drawing element 17, thus constitutes the rotation means for the fabric 9.

At a certain point the roller sensing element 34 of the position plotting means 31 cooperates with the checking element 36 so as to close the microswitch 32 inserted in an electric circuit which produces excitation of an electrovalve (not shown). The latter causes the cylinder 24 to be actuated such that the pin 22 is then moved upwards and passes through the slit 44 to piece the fabric 9. The rotation stage of the fabric 9 is terminated at this point; the fabric 9 being disposed with its edge 10 substantially parallel to the direction of the arrow 7 as illustrated by the perforated line 10'. The stage of transferring the fabric drawn by the two pins 18 and 22 is now begun. The first drawing element 17 and the second drawing element 21 thus constitute the translation means for the fabric 9 and the position plotting element 31 and the checking means 36 constitute the control means for interrupting the rotation stage and beginning the fabric transfer stage.

To obtain this stage of parallelism it is necessary to suitably adjust the position of the checking element 36 along the work bed plate 1 by means of the screws 37.

As the fabric 9 begins to execute its translational movement it is automatically removed from the pin 42 which rotates about 40 as shown in FIG. 3.

The transfer movement is ceased when the edge 10' of the fabric 9 reaches a position in which it can be taken up by an additional conventional tampon or pin-type feeding mechanism 46 (FIG. 1).

In this position the cylinder 28 is arrested and the pins 18 and 22 are lowered beneath the work bed plate 1.

The additional feeding mechanism 46, which moves along a guide 47, reaches the position 46' where the edge 10' of the fabric 9 is inserted in the second sewing machine 5 and is drawn in the direction 7 by the feeding mechanism 6 so as to enable it to be sewn.

During the translational movement of the additional feeding mechanism 46, the cross-piece 25 and thus the drawing elements 17 and 21 return to their starting positions beneath the pressure plate 12.

Although the present invention has been described in connection with a preferred embodiment, it is to be understood that modifications and variations may be resorted to without departing from the spirit and scope of the invention and the appended claims.

What is claimed is:

1. A sewing unit for stitching opposite non-parallel edges of a workpiece of the type having a work bed plate on which first and second sewing machines with their respective feeding mechanisms are mounted in spaced relation, the improvement comprising: a device for transferring the workpiece after completion of stitching one edge thereof by the first sewing machine to the second sewing machine, said device including;

a. a pressure plate (12) mounted on the sewing unit for vertical movement toward and away from the work bed plate;

b. a retaining element (38) attached to said pressure plate (12) for engaging and retaining the workpiece after stitching by the first sewing machine;

c. rotation means defining a first drawing element (17) operatively connected to the work bed plate for vertical and horizontal movement to engage and pivot the unstitched edge of the workpiece on said retaining element (38) into alignment with the second sewing machine;

d. a position plotting element (31) carried by said first drawing element (17) including;

i. a checking element (36) fixed on the work bed plate in operative association with said plotting element (31) for controlling the limit of workpiece movement by said first drawing element (17); and e. a second drawing element (21) connected in spaced relation to said first drawing element (17) for movement in a vertical plane to engage the workpiece and horizontally with said first drawing element (17) for releasing said retaining element (38) while moving the workpiece toward the second sewing machine.

2. The sewing unit according to claim 1 wherein said retaining element (38) includes:

a. a support (39) fixed on said pressure plate (12);

b. a block (41) pivotally mounted in said support (39); and c. a pin (42) depending from said block (41) and pivotable therewith for releasing the workpiece during the initial movement thereof toward the second sewing machine.

* * * * *